United States Patent [19]

Baldenko et al.

[11] Patent Number: 4,823,889

[45] Date of Patent: Apr. 25, 1989

[54] DOWNHOLE SCREW MOTOR

[75] Inventors: Dmitry F. Baldenko, Moscow; Leonid A. Kondratenko, Podolsk; Valery I. Semenets, Moscow, all of U.S.S.R.

[73] Assignee: Vsesojuzny Nauchno-Issledovatelsky Institut Burovoi Tekhniki, Moscow, U.S.S.R.

[21] Appl. No.: 124,776

[22] PCT Filed: Dec. 30, 1985

[86] PCT No.: PCT/SU85/00107

§ 371 Date: Aug. 21, 1987

§ 102(e) Date: Aug. 21, 1987

[87] PCT Pub. No.: WO87/04215

PCT Pub. Date: Jul. 16, 1987

[51] Int. Cl.[4] ..... E21B 43/00

[52] U.S. Cl. ..... 175/107; 415/502

[58] Field of Search ..... 175/107; 415/502

[56] References Cited

U.S. PATENT DOCUMENTS

| | | | |
|---|---|---|---|
| 3,456,746 | 7/1969 | Garrison et al. | 175/107 X |
| 4,019,591 | 4/1977 | Fox | 415/502 X |

FOREIGN PATENT DOCUMENTS

| | | | |
|---|---|---|---|
| 1953477 | 5/1971 | Fed. Rep. of Germany | 175/107 |
| 1224842 | 2/1960 | France | 175/107 |
| 1271127 | 7/1961 | France | 175/107 |
| 237596 | 2/1969 | U.S.S.R. . | |
| 436595 | 3/1981 | U.S.S.R. . | |

OTHER PUBLICATIONS

"Downhole Screw Motor for Well Drilling," M. T. Gusman et al., M. Nedra Publishing House, pp. 3 and 18, 1981.

*Primary Examiner*—William P. Neuder

*Attorney, Agent, or Firm*—Fleit, Jacobson, Cohn & Price

[57] ABSTRACT

A downhole screw motor is designed for drilling oil and gas wells.

A downhole screw motor has a stator (3) and a hollow rotor (4) having an axial passage (5) in which is mounted a flow regulator (6) having a nozzle (16). The surface of the nozzle (16) washed with working liquid is made up of two chambers disposed in series in the flow direction: an admission chamber (A) and a delivery chamber (B), the surfaces (19, 20) of the chambers being conjugated along a breaking line (21). A portion (22) of the admission chamber (A), which is adjacent to the breaking line (21), is convex with respect to the direction of flow of working liquid, and the cross-sectional area of the admission chamber (A) at the outlet thereof is smaller thereof is smaller than the cross-sectional area of the same chamber at the inlet thereof.

5 Claims, 3 Drawing Sheets

DOWNHOLE SCREW MOTOR

TECHNICAL FIELD

The invention relates to positive-displacement hydraulic machines, and in particular, it deals with a downhole screw motor.

BACKGROUND OF THE INVENTION

Two radically different methods are used nowadays for drilling wells. One method is a rotary drilling method, where in the drive of a rock-breaking-tool—bit—is disposed on the ground level, and the bit is rotated through a string of drill pipes. The second method involves the employment of downhole hydraulic machines disposed directly above the bit. The drill pipe string remains stationary in this case. The second method has a number of obvious advantages: there are no energy losses for rotating the drill pipe string; the load on the drill pipes is lowered, hence, the number of emergency situations in the well shaft is reduced.

Downhole screw motors are most widespread used among all types of downholes motors employed nowadays in practical drilling applications. These motors feature easy operation and maintenance; they are compact and make it possible to work with drilling muds of largely varying density and viscosity (cf. Gusman M. T., Baldenko D. F., et al. Downhole Screw Motor for Well Drilling. M., Nedra Publishing House, 1981). Such hydraulic motors generally comprise a casing, an output shaft having radial and thrust bearings, and working members consisting of two elements: an outer rubberized sleeve or stator having internal helical teeth and a rotor and shaft having outer helical teeth accommodated in the stator. The number of teeth of the sleeve is greater than the number of teeth of the shaft by unity so that the interior of the working members is divided into high and low pressure chambers by their mutual engagement when a liquid is pumped through the working members. Under the action of the resultant pressure difference, the rotor starts moving relative to the stator, the axis of the rotor describing a circle about the axis of the stator. This rotation is transmitted to the output shaft of the rotor. Usually a flow of liquid is used as a source of energy for operation of the motor, but the hydraulic motor can also function using an aerated liquid or compressed air.

Nowadays downhole motors used for drilling wells general have the whole flow of liquid passing between the rotor and stator.

One of the main disadvantages of such motors is the dependence of their output parameters on the inlet flow of working liquid. As the production requirements in drilling wells do not frequently take into account energy capabilities of downhole motors, the latter are often used under unfavourable conditions when speed and pressure differences are too high thus resulting in premature failure of parts and assemblies of the motor.

To eliminate this disadvantage, conoid nozzles are mounted in the axial passage of the rotor (cf. USSR Inventor's Certificate No. 436595, Cl. E 21.B 4/00, 1972), the flow of working liquid being throttled through the nozzles.

The characteristic of such motors is dropping, i.e. the output shaft speed decreases with a growth of the load torque much faster than in hydraulic motors that do not have such nozzles. As the load increases, this results in a strong speed decrease until the output motor shaft stops at low load torque values thus resulting in a lower output torque, hence, in a lower efficiency of drilling.

SUMMARY OF THE INVENTION

The invention is based on the problem of providing a downhole screw motor wherein a working liquid flow regulator is so constructed as to increase working output torque and speed of the output shaft of a motor, with the output shaft speed remaining practically unchanged at no-load.

This problem is solved by that in a downhole motor comprising a spindle section and a motor section comprising working members - a stator and a hollow rotor having an axial passage communicating with a working liquid high-pressure zone and accomodating a flow regulator having a nozzle, according to the invention, the nozzle has two chambers disposed in series in the direction of working liquid flow: an addmission chamber and a delivery chamber, the surfaces of the chambers washed with the working liquid being conjugated along a break line, the annular portion of the admission chamber, which is adjacent to the break line, being convex with respect to the direction of working liquid flow, and the cross-sectional area of the admission chamber at the outlet thereof being smaller than the cross-sectional area thereof at the inlet.

The invention makes it possible to increase torque and speed of the output motor shaft thereby improving efficiency of well drilling. When working liquid enters the nozzle, jets stall at the break line to form a powerful vortex in the admission chambers, the vortex energy increasing as the pressure difference increases so as to result in an increase in the hydraulic resistance of the nozzle and causing an increase in the flow of liquid passing between the rotor and stator.

The regulator according to the invention is very compact; it can be easily installed in any motor and may be replaced without disassembly of the hydraulic motor.

In one embodiment of the invention, the nozzle is made-up of two members: a bushing and a rod mounted inside the bushing the admission and delivery chambers being defined by the surfaces of the bushing and rod and are annular in shape.

In another embodiment, the rod is cylindrical, and the bushing is internal provided with an annular projection defining the convex portion of the admission chamber surface.

In still another embodiment of the invention, the bushing is cylindrical, and the rod is provided with an annular projection defining the convex portion of the admission chamber surface.

In a further embodiment of the invention, the bushing and rod have annular projections, each projection defining a convex portion of the admission chamber surface.

All embodiments of the invention make it possible to improve stability of the motor characteristic, i.e. to diminish the dependence of speed on the load at the output shaft. This is achieved because liquid jets flowing along the curvilinear surface of the admission chamber stall at the break-line to form a space with an intensive vertical flow. The higher the pressure difference at the working members (rotor and stator), hence at the nozzle, the more intensive is mixing of liquid jets, the higher is the resistance of the nozzle and the greater is the amount of liquid that passes through a regulator.

This facility makes it possible to cause a greater amount of liquid to pass through the helical surfaces of the rotor and stator than in case conoid nozzles are used.

This result, i.e. an increase in the flow of liquid through the helical surfaces of the rotor and stator upon an increase in the load at the output shaft, can also be obtained using other structural means; however, the general idea of the invention will remain unchanged.

In order to lowr specific load at the nozzle, several nozzles are preferably provided in the axial passage of the rotor. Operation of the apparatus as a whole will in such case remain the same.

BRIEF DESCRIPTION OF DRAWINGS

Other objects and advantages of the invention will become apparent from the following detailed description of specific embodiments illustrated in the accompanying drawings in which.

BEST MODE FOR CARRYING OUT THE INVENTION

Figure 1:
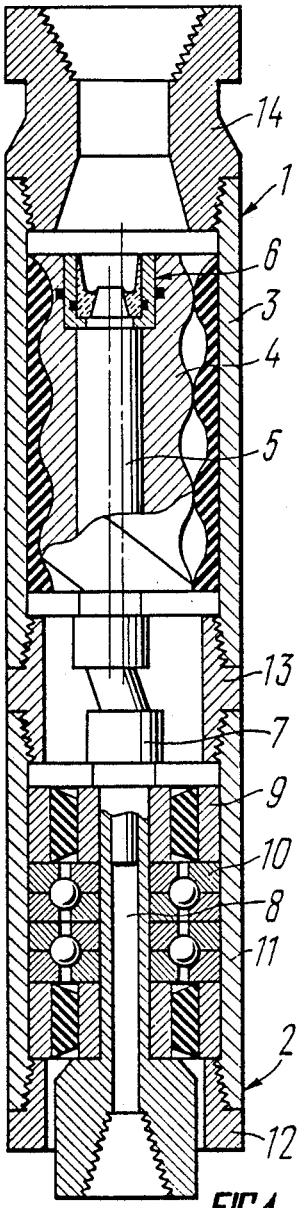
FIG. 1 is a longitudinal section view of a downhole screw motor having one embodiment of a nozzle of a regulator mounted in the axial passage of the rotor.

A downhole screw motor (FIG. 1) comprises a motor section 1 and a spindle section 2. The motor section 1 includes working members: a stator 3 and a hollow rotor 4 mounted therein. The rotor 4 has an axial passage 5 communicating with a high-pressure zone of liquid, and a flow regulator 6 is mounted in this axial passage. The rotor 4 is connected, in the lower part thereof, to a cardan shaft 7 which, in turn, is connected to an output shaft 8 of the spindle section 2. A radial bearing 9 and a thrust bearing 10 secured to the shaft 8 are installed in a casing 11 of the spindle section 2, between a nipple 12 and a stab sub 13. A sub 14 is provided in the upper part of the motor for connecting to a drill pipe string. A rock breaking tool (not shown in the drawing) is connected to the lower part of the output shaft 8.

Figure 2:
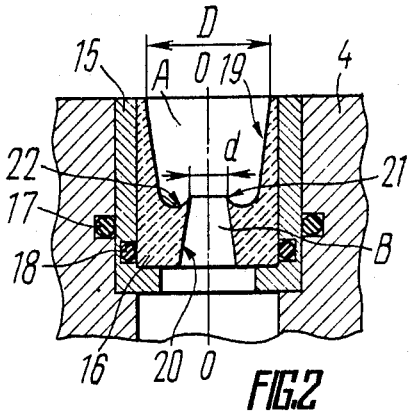
FIG. 2 is a longitudinal section of a flow regulator with a nozzle; enlarged view.

The flow regulator 6 (FIG. 2) comprises a removable casing 15 in which there is mounted a nozzle 16 made. e.g. of a ceramic material. Sealing rings 17 and 18, e.g., of rubber are provided between the casing 15 and rotor 4 and also between the nozzle 16 and casing 15.

The nozzle 16 is made-up of two chambers disposed in series in the direction of the flow of working liquid: an admission chamber A and a delivery chamber B. Surfaces 19 and 20 of the admission chamber A and delivery chamber B, respectively, are conjugated along a break line 21. An annular portion 22 of the admission chamber A, which is adjacent to the break line 21, is convex with respect to the direction of flow of working liquid. Diameter D of the inlet section of the chamber A is greater than diameter d of the outlet section of the same chamber A. In other words, the cross-sectional area of the admission chamber A at the inlet thereof is larger than the cross-sectional area at the outlet of the same chamber A.

The surface 20 of the delivery chamber B may have any appropriate configuration. However, it is preferred that the shape of the chamber B be such as to offer maximum possible resistance to the flow of working liquid passing through the nozzle 16. The surface 20 of the chamber B is formed similarly to the surface 19 of the chamber A by rotating a curve about the axis 0—0 convex with respect to the direction of flow of working liquid.

Both curves forming the chambers A and B intersect each other in the longitudinal section of the nozzle 16 at a point which is equivalent to a break point. Such points form the intersection line 21 in space, which is equivalent to the break line.

The downhole screw motor functions in the following manner. When the drill pumps disposed at the ground level are switched on, drilling mud is supplied through a drill pipe string to the working members of the motor section 1 (see FIG. 1). The flow is divided directly upstream the working members: the main part of the flow will pass between the stator 3 and rotor 4 to impart motion to the latter; the other, smaller part of the flow will pass through the passage 5 of the rotor 4 and flow regulator 6 mounted in the passage 5. Having passed through the working members, both parts of the flow are again forming a single flow which gets to the face through the inner hole of the shaft 8 in the spindle section 2.

Torque provided in the motor section 1 is transmitted from the rotor 4, via the cardan shaft 7, to the shaft 8 and further to the rock-breaking tool (bit).

The amount of resistance torque overcome by the motor depends on cooperation of the bit and the rock being broken. During operation of the motor, the motor torque, as well as the load or resistance torque, undergo changes.

The torque in motors of such a type is known to be proportional to the pressure difference at the working members (in the working of the motor characteristic) at a constant flow of a working liquid. In the prior art motor, as the motor is loaded by an external resistance torque upon a bit rotation the amount of liquid passing between the rotor and stator decreases proportionally with $\sqrt{P}$, wherein P is the pressure difference at the motor. Thus the characteristic of the motor becomes dropping, and the speed of the output shaft 8 materially decreases.

In the motor according to the invention, the flow of liquid getting to the admission chamber A (FIG. 3) moves in a kind of two flows: the main flow along the axis 0—0 of the nozzle 16 moves from the chamber A through the outlet section thereof of the diameter d, which is formed by the break line 21; the other, peripheral part of the flow washes the surface 19 of the chamber A. At the break line 21, this peripheral flow stalls and is intensity mixed with the main central flow. The peripheral flow will be herineafter referred to as a resistance flow.

Therefore, an intensive mixing of the main flow and resistance flow results in a decrease in the energy of flow that gets to the chamber B. The greater the pressure difference at the working members—stator 3 and rotor 4, and respectively, at the nozzle 16, the stronger is the mixing of liquid flows, the smaller is the amount of liquid flowing from the chamber A to the chamber B, and the greater is the amount of liquid admitted to the working members.

Figure 4:
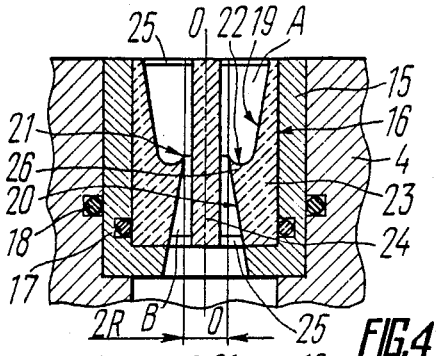
FIGS. 4, 5, 6 show various structural embodiments of nozzles.

As shown in FIG. 4, the nozzle 16 is made-up of two members: a bushing 23 and a cylindrical rod 24 interconnected by bridges 25. Similarly to the abovedescribed structure, the nozzle 16 has two annular chambers disposed in series in the axial direction: the admission chamber A and the delivery chamber B having their surfaces 19 and 20 washed with working liquid. The chambers A and B are defined by the surfaces of the bushing 23 and rod 24. The surface of the bushing 23 is formed by rotating about the axis 0—0 a curve which is convex with respect to a generant of a cylinder of a radius R, wherein R is the minimum distance from the axis 0—0 of the nozzle 16 to a line which is equivalent to the break line 21 formed by intersection of the surface 19 of the chamber A with the surface 20 of the chamber B. In this case, similarly to the abovedescribed embodiment of the invention, the surface 20 of the chamber B is formed by rotating an arbitrary curve about the axis 0—0.

An annular projection is provided on the inner surface of the bushing 23 to form the convex portion 22 of the admission chamber A.

Figure 3:
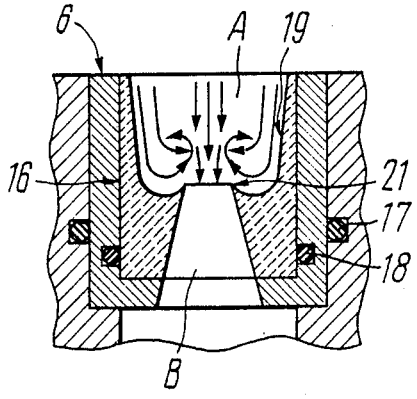
FIG. 3 is a diagram showing flows of liquid passing through the nozzle.

During operation of the embodiment of the regulator, the same result is obtained an in the device shown in FIG. 3 and the difference resides in that the resistance flow moving from the center away from the cylindrical surface of the rod 24 is reflected back to the periphery of the admission chamber A to take part again in mixing with the main flow (secondary mixing).

Figure 5:
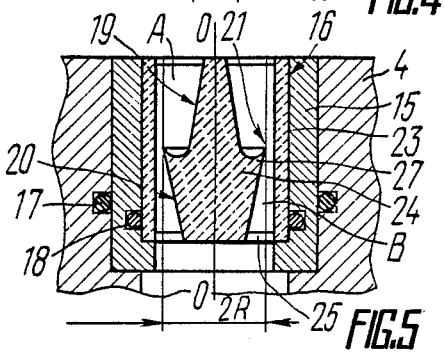

FIG. 5 shows the nozzle 16 also having the bushing 23 and the rod 24 and two chambers: the admission chamber A and the delivery chamber B. In this embodiment of the nozzle 16, the bushing 23 is cylindrical and the rod 24 is made with an annular projection 27 defining the convex portion 22 of the surface 19 of the admission chamber A. The surface of the bushing 23 washed with working liquid is cylindrical, and the surface of the rod 24 in the chamber B is defined by rotating about the axis 0—0 a curve which is convex with respect to a generant of a cylinder of a radius R, wherein R is the minimum possible distance from the axis 0—0 of the nozzle 16 to the line 21 which is equivalent to a break line formed by intersection of the areas of the surface of the rod 24 (in the chamber A) and surface of the rod 31 (in the chamber B).

Unlike the motor shown in FIG. 3, here the resistance flow, which moves along a curvlinear surface away from the center of the nozzle towards its periphery, is reflected from the cylindrical surface of the bushing 23 towards the center and again, but with a lower energy, and takes part in the mixing with the main flow.

Figure 6:
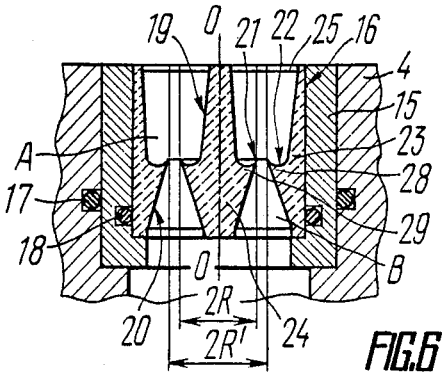

The nozzle 16 shown in FIG. 6, similarly to the two above-described embodiments, has two members: the bushing 23 and the rod 24 interconnected by bridges 25. The nozzle also has two chambers disposed in series in the axial direction: the admission chamber A and the delivery chamber B having their surfaces 19, 20 washed with working liquid. The bushing 23 has an annular projection 28 and the rod 24 has an annular projection 29. Each of the projections 28, 29 defines the convex portion 22 of the surface 19 of the admission chamber A. The surfaces of the bushing 23 and rod 24 disposed within the chamber A are formed by rotating about the axis 0—0 curves each of which is convex with respect to a general of a cylinder of a radius R, wherein R is the minimum possible distance from the axis 0—0 of the nozzle 16 to a respective line which is equivalent to the break line 21.

Operation of the flow regulator is distinguished in the fact that here two resistance flows are formed: one which moves along the curvilinear surface of the bushing 23 from the periphery towards the center of the nozzle 16, and the other which moves along the curvilinear surface of the rod 24 from the center of the nozzle 16 towards the periphery thereof. These flows intersect one another within a ring defined by radii R and R′ so as to contribute to a further mixing of liquid flows.

Therefore, in the abovedescribed, embodiments of the motor according to the invention, with the presence of two parallel flows one of which has its own auxiliary resistance flows the energy of the latter increases with an increase in the pressure difference, i.e., as the motor is loaded with an external torque, the dependence of the amount of liquid passing through the working members and also through the nozzle 16 on the motor loading conditions is of a complicated character. It can be, however, shown that use in the flow regulator of the nozzle constructed as described here will make the energy characteristic of the motor stable to a greater extent thus bringing about, quite naturally, an increasse in its loading capacity and a very small decrease in the motor output shaft speed.

Figure 7:
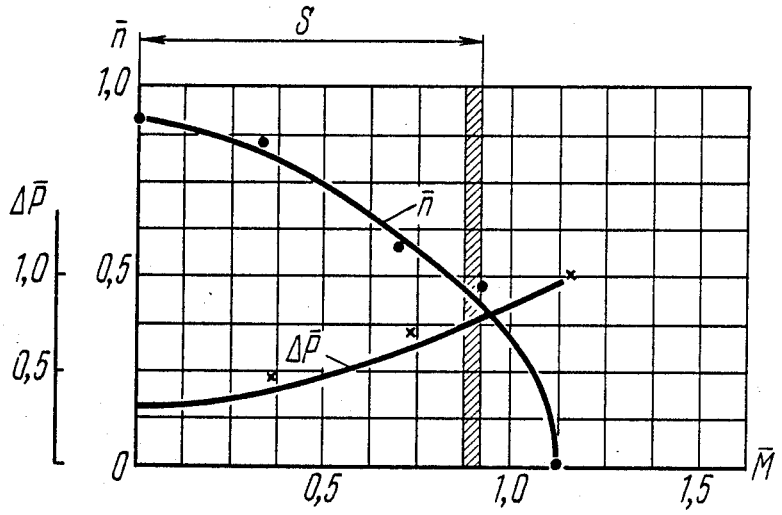
FIGS. 7, 8 show experimentally obtained energy characteristics for prior art and this invention.
Figure 8:
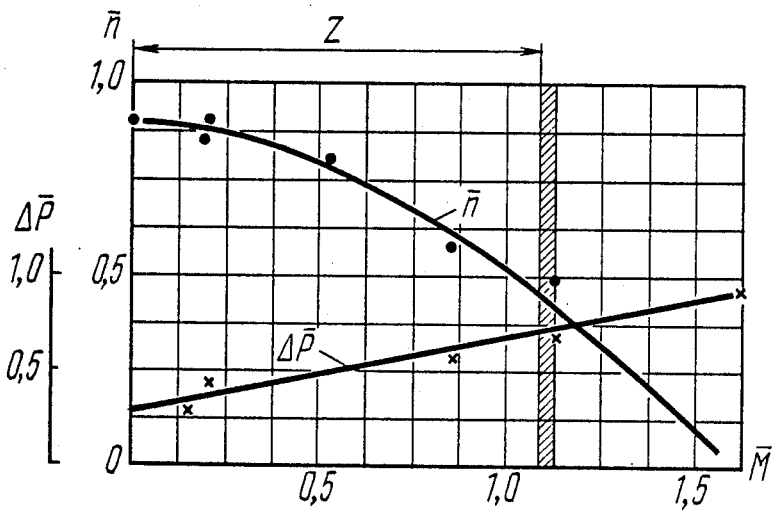

FIGS. 7 and 8 show energy characteristics, i.e., relationship between the relative pressure differential values $\Delta P$ and rotation frequency $\bar{n}$ of the output shaft 8, and the relative torque value M of a prior art screw motor and the screw motor according to the invention.

Study of the characteristics given in the drawings shows that a zone S of stable operation of the motor in FIG. 8 is 18% larger than a zone Z of stable operation of the motor in FIG. 7 in terms of torque. Speed decrease in the prior art motor is 57% for the same point and 50% for the motor according to the invention. If the speed decrease is considered for both motors with application of one and the same external torque, the difference will be much greater. This is due to the fact that the motor having a flow regulator will be supplyed upon an increase in the pressure at the working members an increased amount (as compared to the prior art) of liquid each time so that only the stability of the characteristic is improved, but average values of working torque and speed are also increased.

INDUSTRIAL APPLICABILITY

The invention may be most efficiently used in positive displacement downhole motors used as a drive for a rock-breaking tool in drilling oil and gas wells.

The invention may also be used in turbodrills.

We claim:

1. A downhole screw motor comprising a spindle section (2) and a motor section (1) having working members in the form of a stator (3) and a hollow rotor (4) having an axial passage (5) communicating with a high-pressure zone of working liquid, a regulator (6) of working liquid flow having a nozzle (16) being mounted in the axial passage, characterized in that the nozzle (16) has two chambers disposed in series in the direction of working liquid flow an admission chamber (A) and a delivery chamber (B) having their surfaces (19, 20) washed with liquid which are conjugated along a breaking line (21), an annular portion (22) of the admission chamber (A), which is adjacent to the breaking line (21), being convex with respect to the direction of working liquid flow, and the cross-sectional area of the admission chamber (A) at the outlet thereof being smaller than the cross-sectional area of the same chamber at the inlet thereof.

2. A downhole screw motor according to claim 1, characterized in that the nozzle (16) is made-up of two members: a bushing (23) and a rod (24) mounted inside the bushing, the admission (A) and delivery (B) chambers being defined by surfaces of the bushing (23) and rod (24) and being annular in shape.

3. A downhole screw motor according to claim 2, characterized in that the rod (24) is cylindrical and the bushing (23) is internally provided with an annular projection (23) defining the convex portion (22) of the surface (19) of the admission chamber (A).

4. A downhole screw motor according to claim 2, characterized in that the bushing (23) is cylindrical and the rod (24) has an annular projection (27) defining the convex portion (22) of the admission chamber (A).

5. A downhole screw motor according to claim 2, characterized in that the bushing (23) and rod (24) have annular projections (28, 29), each projection defining the convex portion (22) of the surface (19) of the admission chamber (A).

* * * * *